United States Patent [19]

Westling

[11] Patent Number: 4,478,891

[45] Date of Patent: Oct. 23, 1984

[54] METHOD OF REDUCING THE EMISSION OF FORMALDEHYDE FROM PARTICLE BOARD BOUND WITH CARBAMIDE RESIN

[75] Inventor: Anders W. Westling, Upplands Väsby, Sweden

[73] Assignee: AB Statens Skogsindustrier, Stockholm, Sweden

[21] Appl. No.: 515,185

[22] Filed: Jul. 19, 1983

Related U.S. Application Data

[63] Continuation of Ser. No. 192,602, Sep. 30, 1982, abandoned.

[51] Int. Cl.[3] ..... B05D 3/02

[52] U.S. Cl. ..... 427/317; 427/189; 427/226; 427/325; 427/399; 427/401

[58] Field of Search ..... 427/189, 180, 202, 226, 427/324, 317, 325, 326, 399, 401, 421, 439, 440; 428/537, 326; 162/225

[56] References Cited

U.S. PATENT DOCUMENTS

| | | | |
|---|---|---|---|
| 3,113,065 | 12/1963 | Newton et al. | 162/225 |
| 3,420,696 | 1/1969 | Cotton et al. | 427/399 |
| 3,936,542 | 2/1976 | Cox | 427/324 |
| 4,025,490 | 5/1977 | Weaver | 428/326 |
| 4,162,178 | 7/1979 | Mankessini | 428/326 |
| 4,163,820 | 8/1979 | Corver et al. | 428/326 |
| 4,254,178 | 3/1981 | Church et al. | 428/326 |

FOREIGN PATENT DOCUMENTS

| | | | |
|---|---|---|---|
| 2379374 | 9/1978 | France | 427/399 |
| 539117 | 2/1977 | U.S.S.R. | 162/90 |

OTHER PUBLICATIONS

Wittman, "The Subsequent Dissociation of Formaldehyde from Particle Board", vol. 20, No. 6, pp. 221–224, Jun. 1962.

Chemical Abstracts, vol. 83, 1975, 99549j.

*Primary Examiner*—S. L. Childs

*Attorney, Agent, or Firm*—Fred Philpitt

[57] ABSTRACT

The emission of formaldehyde from particle board bound with carbamide resin is reduced by coating the boards, during their manufacture and subsequent to pressing the same, with at least one ammonium compound which decomposes thermally at the temperature of the boards during the conditioning period, whereafter the boards are stacked and stored for conditioning.

14 Claims, No Drawings

METHOD OF REDUCING THE EMISSION OF FORMALDEHYDE FROM PARTICLE BOARD BOUND WITH CARBAMIDE RESIN

This is a continuation of application Ser. No. 192,602, filed Sept. 30, 1982, now abandoned and the benefits of 35 USC 120 are claimed relative to it.

The present invention relates to a method of reducing the emission of formaldehyde from particle board bound with carbamide resin.

Binding agents normally used when manufacturing particle board are curable formaldehyde-based binders, which are cured by using acid or acid-forming compounds. In most cases the binding agent is a urea formaldehyde resin, although melamine formaldehyde resin and mixtures of urea and melamine resins are also used.

When curing these resins, a given surplus of formaldehyde is required. This surplus amounts to 0.02–0.2% of the weight of the finished board, and departs slowly from the board.

The allergenic and irritation properties of formaldehyde are well known, and it is thus desirable from the aspect of working hygiene and environmental hygiene to reduce as far as possible the content of free formaldehyde in the boards. Thus various methods of reducing the content of free formaldehyde in the boards have been suggested, such as the use of a binding agent having a low molar ratio of urea to formaldehyde, and also the treatment of the finished boards with gaseous ammonia has been suggested (French Patent Specification No. 2 379 374). This latter methodology is based on the known fact that formaldehyde reacts with ammonia to form hexamethylenetetramine, which is a substance stable and solid at room temperature. In accordance with the proposed method, gaseous ammonia or a mixture of gaseous ammonia and air is drawn through the boards during the process of their manufacture. The method, however, is both complicated and energy consuming. The boards are passed through apparatus which create a difference in pressure between the top and bottom surfaces of the board, resulting in sealing difficulties and chemical losses.

This problem has been solved in a surprisingly simple and effective manner by means of the present invention. Subsequent to the boards being pressed and cooled to some extent and having been passed on to a roller conveyor path, they are coated, in accordance with the invention, with a thin layer of at least one ammonium compound which decomposes thermally at the prevailing temperature of the boards during the conditioning period, whereafter the boards, while still at elevated temperature, are stacked for the binder to cure further and for conditioning of the boards. Subsequent to this curing and conditioning period, the boards are cut to size and sanded, as before.

Thus, the method according to the invention is characterized by coating the boards, during the manufacture thereof and subsequent to pressing said boards, with at least one ammonium compound which decomposes thermally at the temperature of the boards during the conditioning period, and then stacking the boards for conditioning.

The temperature of the boards when stacked for conditioning is normally from 40° to 70° C. During the conditioning period, which is normally one to three full days, the ammonium compound or compounds decompose and emit gaseous ammonia, which penetrates the boards and reacts with the free formaldehyde to form hexamethylenetetramine. In this way, there is obtained an immediate, strong action on the free formaldehyde present in the boards.

It is surprising that the gaseous ammonia formed penetrates so well into the boards, instead of spreading outwardly from the stack, especially since no special measures are taken to seal the sides of said stack.

In view of the temperatures which normally prevail during the conditioning period, the ammonium compounds used are preferably those which will emit ammonia to a substantial extent at temperatures from 40° to 70° C. Particularly preferred compounds are ammonium hydrogen carbonate and ammonium carbonate. As will readily be understood, the ammonium compound used may not be explosive, and neither may it produce unacceptable residual ions or compounds as it decomposes.

The ammonium compounds may be applied, for example, in powder form or in the form of a solution, which is preferably concentrated. For environmental reasons, the solution is suitably an aqueous solution, although the binding of the formaldehyde can also be achieved when using other solvents than water.

If desired, ammonium acetate can be added to the aqueous solution, to lower the pH thereof.

When the ammonium compound used is in solution form, preferably both sides of respective boards are sprayed with the solution, while when in powder form the compound is only applied to the upper surface of respective boards.

The combination of a decrease in the content of free formaldehyde and a further decrease in the emission is obtained when the boards, in accordance with the invention, are coated with a solution which in addition to the ammonium carbonate and/or ammonium hydrogen carbonate, also comprises urea.

As a result of the application of urea to the boards in accordance with this embodiment of the method there is obtained an enhanced effect on the emission values of the formaldehyde, because the urea does not decompose thermally during the conditioning period, but remains in the vicinity of the outer surfaces of the boards and acts as a shield against the departure of formaldehyde, as a result of a chemical reaction between the urea and the formaldehyde.

The quantities in which the ammonium compound, and the urea, where appropriate, is or are used depends upon the thickness of the board. In the case of board having a thickness of 15 mm, there is normally obtained a clear reduction in the content of free formaldehyde with 5 g of the thermally decomposable ammonium compound per $m^2$, while a marked shield effect is obtained with 4 g of urea per $m^2$. Preferably at least 10 g of ammonium compound and at least 5 g of urea are used per square meter of board. In general, an increase in the amount of thermally decomposable ammonium compound above 40–50 g per $m^2$ and in the amount of urea above 20–25 g per $m^2$ will only result in marginal improvements.

The amount of ammonium acetate, when used, depends mainly on the desired pH, and normally lies in the region of 3–10 g/$m^2$.

When a combination of urea and thermally decomposable ammonium compound or compounds is used, the weight ratio between these components can be varied within wide limits. There is, however, suitably used a weight ratio of urea to ammonium compound(s) of from 1:2 to 1:10.

The invention will now be illustrated with reference to a number of working examples, of which Examples 1–6 were carried out with boards 500 x 500 mm in size.

EXAMPLE 1

Particle boards having a thickness of 12 mm were coated with finely pulverized ammonium carbonate, 10 g/m², stacked and stored for 48 h at 60° C.

EXAMPLE 2

Particle boards having a thickness of 12 mm were coated with finely pulverized ammonium carbonate, 20 g/m², stacked and stored for 48 h at 60° C.

EXAMPLE 3

Particle boards having a thickness of 16 mm were coated with finely pulverized ammonium carbonate, 15 g/m², stacked and stored for 48 h at 40° C.

EXAMPLE 4

Particle boards having a thickness of 16 mm were sprayed with an aqueous solution of 20 g ammonium carbonate in 100 g solution, said boards being coated with 50 g solution per m² and side. The boards were then stacked and stored for 48 h at 60° C.

EXAMPLE 5

Particle boards having a thickness of 16 mm were sprayed with an aqueous solution of 20 g ammonium carbonate in 100 g water, said boards being coated with 100 g solution per m² and side. The boards were then stacked and stored for 48 h at 60° C.

EXAMPLE 6

Particle boards having a thickness of 16 mm were sprayed with an aqueous solution of 16 g ammonium carbonate and 4 g ammonium acetate in 100 g solution, said boards being coated with 100 g solution per m² and side. The boards were then stacked and stored for 48 h at 60° C.

EXAMPLE 7

Particle boards (2.5×21 m) having a thickness of 18 mm were sprayed with an aqueous solution of 182 kg ammonium hydrogen carbonate and 50 kg urea in 1000 l solution, the boards being coated with 150 g solution per m² and side. The boards were then stacked and stored for 48 h at 60° C. The emission of formaldehyde measured in a state of equilibrium in a climate chamber was about 40% of the emission in corresponding, untreated board.

After conditioning, the content of free formaldehyde was determined in all tests in accordance with the FESYP-perforator method (British Standard 1811). In a number of the tests, the boards were tested for swelling, transverse strength and modulus of rupture in accordance with DIN 68761. Corresponding boards which had been solely heat treated and conditioned were used as reference material. Each test was carried out with six boards. The measuring results are given in Table I below.

TABLE I

| Example | Board thickness in mm | Salt g/m² | Storage temp. °C. | Swelling % | Transverse strength MPa | Modulus of rupture MPa | Free formaldehyde % by weight |
|---|---|---|---|---|---|---|---|
| 1 | 12 | 10 | 60 | | | | 0.016 |
| 2 | 12 | 20 | 60 | | | | 0.011 |
| 3 | 16 | 15 | 40 | 5.6 | 0.75 | 17.0 | 0.012 |
| 4 | 16 | 10 | 60 | 8.9 | 0.35 | 16.0 | 0.017 |
| 5 | 16 | 20 | 60 | 8.9 | 0.36 | 18.8 | 0.012 |
| 6 | 16 | 20 | 60 | | | | 0.013 |
| 7 | 18 | 35 | 60 | | | | 0.009 |
| Ref 1 | 12 | 0 | 60 | | | | 0.032 |
| Ref 2 | 16 | 0 | 60 | 8.6 | 0.32 | 17.2 | 0.030 |

EXAMPLE 8

Particle boards having a thickness of 12 mm were sprayed with an aqueous solution of 200 kg ammonium carbonate per 1000 l solution, the boards being coated with 100 ml solution /m² and side. The boards were then stacked and stored for 24 h at 60° C.

EXAMPLE 9

Particle boards having a thickness of 12 mm were sprayed with an aqueous solution of 182 kg ammonium hydrogen carbonate and 100 kg urea per 1000 l solution, the boards being coated with 100 ml solution /m² and side. The boards were then stacked and stored for 24 h at 60° C.

The emission of formaldehyde of boards manufactured according to Examples 8 and 9 above and reference boards of 12 mm thickness manufactured in a corresponding way but not being sprayed with an aqueous solution according to the invention was determined in a state of equilibrium (about 10 days after the start of the test) in a climate chamber under the following conditions:

Temperature: 23° C.
Relative humidity: 45%
Ventilation: 0.25 per h
Load of particle board: 2.25 m²/m³ chamber volume.

The results are given in Table II below.

TABLE II

| Board according to Example | Board thickness in mm | Salt g/m² | Storage temp. °C. | Free formaldehyde % by weight | Emission mg formaldehyde /m³ air |
|---|---|---|---|---|---|
| 8 | 12 | 40 | 60 | 0.011 | 0.39 |
| 9 | 12 | 56 | 60 | 0.015 | 0.37 |
| Ref. | 12 | 0 | 60 | 0.031 | 0.99 |

I claim:

1. A method of reducing the emission of formaldehyde from particle board bound with carbamide resin, wherein subsequent to being pressed the boards are cooled to a temperature of 40°–70° C., then the boards are coated with a concentrated aqueous solution containing (a) at least one ammonium compound selected from the group consisting of ammonium carbonate and ammonium hydrogen carbonate, and (b) urea, and then immediately after coating the boards are stacked for at least one day for conditioning, the weight ratio of urea to said ammonium carbonate being from 1:2 to 1:10, the amount of the ammonia compound being at least 10 g per square meter of board and the amount of urea being at least 5 g per square meter of board.

2. A method of reducing the emission of formaldehyde from particle board bound with carbamide resin, wherein subsequent to being pressed the boards are cooled to a temperature of 40°–70° C., then the boards are coated with a concentrated aqueous solution containing (a) at least one ammonium compound selected from the group consisting of ammonium carbonate and ammonium hydrogen carbonate, and (b) urea, and then immediately after coating the boards are stacked for at least one day for conditioning, the weight ratio of urea to said ammonium compound being from 1:2 to 1:10, said aqueous solution containing ammonium acetate for regulating the pH, the amount of the ammonia compound being at least 10 g per square meter of board and the amount of urea being at least 5 g per square meter of board.

3. A method of reducing the emission of formaldehyde from particle board bound with carbamide resin which comprises the steps of (a) cooling the pressed particle boards to a temperature conventional in conditioning, (b) coating the particle boards with at least one ammonium compound selected from the group consisting of (1) ammonium carbonate, and (2) ammonium hydrogen carbonate, and (c) stacking the coated particle boards in a stack for conditioning.

4. A method according to claim 3 wherein the boards are treated with a concentrated solution of said ammonium compound.

5. A method according to claim 4 wherein the solution is an aqueous solution.

6. A method according to claim 5 wherein the aqueous solution also contains ammonium acetate for regulating the pH.

7. A method according to claim 3 wherein the boards are coated with a solution which, in addition to ammonium carbonate or ammonium hydrogen carbonate, also contains urea.

8. A method according to claim 4 wherein the boards are coated with a solution which, in addition to ammonium carbonate or ammonium hydrogen carbonate, also contains urea.

9. A method according to claim 5 wherein the boards are coated with a solution which, in addition to ammonium carbonate or ammonium hydrogen carbonate, also contains urea.

10. A method according to claim 6 wherein the boards are coated with a solution which, in addition to ammonium carbonate or ammonium hydrogen carbonate, also contains urea.

11. A method according to claim 7 wherein the weight ratio of urea to ammonium compound is from 1:2 to 1:10.

12. A method according to claim 8 wherein the weight ratio of urea to ammonium compound is from 1:2 to 1:10.

13. A method according to claim 9 wherein the weight ratio of urea to ammonium compound is from 1:2 to 1:10.

14. A method according to claim 10 wherein the weight ratio of urea to ammonium compound is from 1:2 to 1:10.

* * * * *

UNITED STATES PATENT AND TRADEMARK OFFICE

CERTIFICATE OF CORRECTION

PATENT NO. : 4,478,891

DATED : October 23, 1984

INVENTOR(S) : Anders W. Westling

It is certified that error appears in the above-identified patent and that said Letters Patent is hereby corrected as shown below:

On the title page assignee should read

-- (73) Assignee: Swedspan AB, Vaxjo, Sweden --.

Signed and Sealed this

*Twenty-third* Day of *April 1985*

[SEAL]

*Attest:*

DONALD J. QUIGG

*Attesting Officer*

*Acting Commissioner of Patents and Trademarks*